US007472708B2

(12) United States Patent
Eigenbrod et al.

(10) Patent No.: US 7,472,708 B2
(45) Date of Patent: Jan. 6, 2009

(54) ATTACHABLE INDIVIDUAL CURLS

(76) Inventors: Pamela Eigenbrod, 1215 Borden Rd., Depew, NY (US) 14043; Laura Peters, 215 Clinton St., Cowlesville, NY (US) 14037; Dorothy Tudor, 24 Argus Dr., Depew, NY (US) 14043

( * ) Notice: Subject to any disclaimer, the term of this patent is extended or adjusted under 35 U.S.C. 154(b) by 233 days.

(21) Appl. No.: 11/132,057

(22) Filed: May 18, 2005

(65) Prior Publication Data

US 2006/0260631 A1 Nov. 23, 2006

(51) Int. Cl.
*A41G 5/00* (2006.01)
*A41G 3/00* (2006.01)

(52) U.S. Cl. ..... 132/55; 132/201

(58) Field of Classification Search ..... 132/200, 132/201, 53–56, 105; D28/92
See application file for complete search history.

(56) References Cited

U.S. PATENT DOCUMENTS

| | | | | | |
|---|---|---|---|---|---|
| 54,116 | A * | 4/1866 | Cook | 132/53 |
| 96,275 | A * | 10/1869 | Shaw | 132/53 |
| 105,914 | A * | 8/1870 | Cohen | 132/53 |
| 122,183 | A * | 12/1871 | Mayer | 132/53 |
| 193,304 | A * | 7/1877 | Wells | 132/53 |
| 517,107 | A * | 3/1894 | Lambert | 132/53 |
| 1,403,792 | A * | 1/1922 | Levussove | 132/201 |
| 1,441,820 | A * | 1/1923 | Saul | 132/280 |
| 3,456,657 | A * | 7/1969 | Smith | 132/53 |
| 3,500,836 | A * | 3/1970 | Jordan | 132/252 |
| 3,561,457 | A * | 2/1971 | Duesel | 132/53 |
| 3,688,779 | A * | 9/1972 | Greco | 132/53 |
| 4,254,783 | A | 3/1981 | Kim | |
| 4,830,029 | A | 5/1989 | Bird | |
| 4,934,387 | A * | 6/1990 | Megna | 132/201 |
| D356,398 | S | 3/1995 | Hafid | |
| 5,493,735 | A | 2/1996 | Rice | |
| 6,016,814 | A * | 1/2000 | Elliott | 132/201 |
| 6,035,861 | A | 3/2000 | Copello | |
| D440,714 | S | 4/2001 | Sartena | |
| 6,513,535 | B1 * | 2/2003 | Lane | 132/201 |
| 6,634,366 | B1 | 10/2003 | Simmons | |
| 6,832,614 | B2 | 12/2004 | Frazier | |
| 7,174,900 | B2 * | 2/2007 | Lane et al. | 132/273 |
| 2001/0035192 | A1 * | 11/2001 | Townsend | 132/201 |
| 2003/0226571 | A1 * | 12/2003 | Rahman | 132/201 |
| 2004/0163660 | A1 * | 8/2004 | Kellmann | 132/201 |
| 2004/0226571 | A1 | 11/2004 | Lee | |
| 2006/0169296 | A1 * | 8/2006 | Gill et al. | 132/53 |

* cited by examiner

*Primary Examiner*—Robyn Doan
*Assistant Examiner*—Rachel A Running
(74) *Attorney, Agent, or Firm*—Patricia M. Costanzo

(57) ABSTRACT

Attachable, individual curls create desired hair styles by attaching required curls to a patron's head. Curls are formed from natural and/or synthetic hair, have any desired color or size. Curls are offered individually or in a kit containing all curls required for a desired hairdo, including, but not limited to hair-weft, French, spiral, ribbon, fountain-shaped, braided, and fan-shaped curls. A kit may contain curls of one or assorted colors and may be decorated with, for example, sparkles, flowers, bows, jewels, other jewelry items, thematic decorations for various days of celebration. Curls may be disposable or reusable. Kits may contain curls with accessory attachment means and decorative items. If desired, kits and/or individual curls may be purchased with photos of and directions for achieving a desired hairdo. Curls are formed by shaping one end of a sized weft as desired, and securing the individual hairs of the other end.

19 Claims, 9 Drawing Sheets

Provide a commercial length of a hair weft, also referred to as a swatch of hair.

Step 1

Cut commercial length of the hair swatch into sizes required for making desired curls.

Step 2

Fashion sized swatches into desired curls.

Step 3

Provide a binding means, such as an adhesive or a sewing means.

Step 4

Using binding means, bind the hairs of the uncurled end of each curl thus forming an attachment means for attaching the Step 5

Fig. 8

ATTACHABLE INDIVIDUAL CURLS

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE OR A COMPUTER PROGRAM LISTING COMPACT DISK APPENDIX

Not Applicable

BACKGROUND

The present invention generally relates to hair attachment pieces. More particularly, the invention relates to individual, attachable curls, including, among others, hair-weft curls, French curls, spiral-curls, ribbons, fountain-shaped curls, fan-shaped curls, and wired-braids all created from a single commercially available weft of hair, where each curl is easily and rapidly attached to a patron's head to create, or replicate, nearly any desired hairstyle, including hairstyles that are impossible to achieve absent this invention. The curls, made and used according to the principles of the present invention, are especially appreciated by persons with shorter, finer, and/or otherwise unmanageable hair, including those who suffer from hair loss caused by disease or medications. The use of these curls provides for the creation of intricate hairstyles in a minimum amount of time, wherein creating those same hairstyles without these curls would be time consuming, if, indeed, they could be created at all.

The background information discussed below is presented to better illustrate the novelty and usefulness of the present invention. This background information is not admitted prior art.

Wigs have been and still are used to augment hair deficiencies and/or for purposes of adornment. Hair deficiencies include: (1) damaged hair where such damage often occurs from too frequent bleaching, straightening, or curling, (2) naturally "thin" hair (Note: the term thin may refer to a head of hair that appears to suffer from hair loss or to hair that comprises hair shafts that are individually thin or to both conditions.), (3) hair that is too short for any styles that involve curls, and (4) hair loss due to age, disease, or medical treatment. Additionally, wigs may often be used simply for fun or to achieve a desired appearance.

The use of wigs can be traced back at least as far as the earliest days of Egyptian civilization when women often donned heavy, curly black wigs for ceremonial occasions. Much later, in the $18^{th}$ century, the use of wigs, especially elaborate wigs, high coiffures, and highly decorated curls, became exceedingly popular. Today, although not as popular as they once were, wigs are still worn. Wig manufacturers create hair replacements that look as natural as possible. Even so, modern full wigs are still often heavy, hot, and uncomfortable, especially in warm and humid weather. Most present day wigs are permanently shaped and styled into a specific hairstyle that is not amenable to restyling. While some wigs may be styled into more than one particular hair style, they are extremely limited as to the number of hair styles that they can support.

Accordingly, the use of full wigs has been, at least partially, replaced by the use of smaller hair pieces intended to supplement a natural head of hair, rather than to replace it. Such partial wigs attempt to overcome the inconveniences of full wigs and the various shortcomings of the wearer's hair. Partial wigs are often relatively large tresses of hair of varying lengths that may be attached to one's own hair with ornamental combs, bobby pins, or hair clips, for example. Partial wigs are most frequently used to add body and/or length to one's natural hair to achieve a desired effect, which effect is not possible without the use of a partial wig. Although such hair-pieces may be more comfortable to wear than a full-sized wig (but, may not be depending on the method used to affix the hair-piece to one's head) they all suffer from the facts that either they are pre-styled in an unalterable hair-style or they are supplied unstyled and need to be styled for each use, i.e., washed, trimmed, set, and combed. Styling a hair piece takes just as much time and effort as styling a natural head of hair and, of course, the more complex the style, the more time it will take to achieve a desired style. Moreover, as partial wigs are relatively large and are usually of one color (e.g., blonde, brown, red, etc.), it is difficult to find one that is a good color match for one's natural hair. A good color match is important if one wants to conceal the fact that a partial wig is being used.

Despite all of the problems inherent in full wigs, partial wigs, and natural heads of hair that are lacking in some way, fashion conscious women still request hair stylists to provide them with hair styles that will make a desired fashion statement. Such fashion conscious women often search fashion magazines for the latest hairstyles or for hairstyles that offer a particular desired look. Photographs of models with elaborate hairstyles often entice patrons into asking the hair stylist to recreate the illustrated elaborate hairstyle for them. Sometimes such a recreation is possible. A few women are naturally endowed with a thick, luxuriant head of hair that is amenable to high-fashion styling, and for these women, hair stylists can probably recreate the illustrated hair-style desired by the patron. Such recreations, however, require a significant amount of time, and if the patron insists on an exactly identical creation, the styling may require even more time. Both stylist and patron will have to be willing to spend the extra time required to achieve the desired result. This means that patrons will have to spend more time than usual to obtain the desired results and stylists will not be able to accommodate as many patrons. Moreover, other patrons will not be happy with the length of time they have to wait for the stylist to finish the demanding recreation. Consequently, it is clear that there is a need for a method and means that would provide for a desired hair-style to be recreated in a reasonable amount of time so that patrons will be able to have the look they want without spending undue amounts of time and money in a beauty salon. This would also free-up time for hair-stylists, so that they will be able to schedule more patrons in a give amount of time, so that patrons will not have to wait for an unnecessarily delayed appointment.

Cost is certainly a limitation on the potential for achieving elaborate and intricate hairstyles using the techniques and products currently. Cost, as implied earlier, directly correlates with the amount of time involved in fashioning many styles. Providing a way to shorten the time it takes for a stylist to create intricate and complicated hairstyles would be a time and cost boon to hairstylists, as well as fulfilling consumer needs.

Most women, however, are not endowed with a head of hair that is thick, luxuriant and healthy. The majority of women have hair that is lacking either in fullness or in length. Persons with fine, thinning, or shorter hair often enter a salon with high expectations of leaving with a hair-style chosen from a fashion magazine only to be disappointed at the outcome. This dissatisfaction is not caused by a lack of skill of the hair dresser, but is the result of the fact the hair stylists are very limited in the styles that can be performed successfully with a head of hair that suffers from any or all of the above mentioned short comings. Under such circumstances, there is no chance for even the most gifted hair-stylist to duplicate a desired hair-style using only the hair available on a patron's head. Currently available hair attachments and accessories may allow some broadening of hairstyle scope, but these attachments and accessories all suffer to some extent from the problems mentioned above. Many beauty salon patrons would greatly appreciate a product that would enable hair stylists to recreate desired hairstyles that were previously unattainable due to the patron's poor natural hair conditions. Thus, it is clear that there is still a need for a hair embellishment technique or device that can further expand hairstyle possibilities and that can do so without requiring an undue amount of time.

Accordingly, it is abundantly clear that there is an as yet unmet need for a hair styling method and/or device that can overcome the discomfort and style limitations of full wigs as well as the time constraints and style limitations that smaller hair pieces currently face. Thus, it is clear that there is still a need for a hair embellishment technique or device that can further expand hairstyle possibilities and that can do so without requiring an undue amount of time.

SUMMARY

The present invention solves all the aforementioned hair styling problems in that it provides for a hair device and method of styling hair that is comfortable, expands the hair style possibilities for individuals with longer shorter, fine, thin, and/or otherwise unmanageable hair. Moreover, this invention, as taught herein, provides for significant economic advantage over the prior art as it provides the means and method for hair stylists to achieve elaborate hairstyles in a fraction of the time required without the means and methods of the invention. Thus, beauty salon owners and stylists are now able to increase the profitability of their business by permitting stylists to cater to more clients in less time, and thus improving customer service and customer satisfaction.

Now when hairstylists are confronted with having to create or to recreate hair styles for clients who may have one sort of hair problem or another, the hairstylist can rely on the present invention for the means and methods to avoid disappointing clients. By utilizing the current invention, stylists are not restricted in the hair styling possibilities, even if a customers' hair may be wispy, shorter or unmanageable. The labor involved in curling, molding, and shaping even long, easy to manage hair into an elaborate hair style has been eliminated by the current invention. A stylist is now able to easily and rapidly affix the curls of the current invention to a client's head regardless of the length, thickness, or condition of the client's hair, to create or recreate almost any desired style providing for a happy customer and hair stylist.

In addition to being able to please clients by providing them with the hair style they desire, the time required to produce such styles is another major factor in hair salon profitability. Elaborate hair styles require more time to achieve, and while a salon can ultimately charge more money for elaborate hairstyles, there is a limit as to how much clients are willing to spend on a particular hair style. Such cost thresholds may vary from market to market, but they exist and determine how much any individual stylist is able to earn. Due to the short amount time per customer needed to finish elaborate hairstyles using the devices and methods taught by the current invention, hair stylists are now able to increase their earning potential by reducing the time spent on each client. By reducing the time required to achieve a desired hair style, the present invention also eliminates customer dissatisfaction generated by heretofore long waits for appointments that may have been caused by the delay due to a previous client's hair styling session. The present invention provides for elaborate and elegant hair styles to be replicated in a fraction of the time previously required.

Elaborate and elegant hairstyle are often desired, for example, by young women attending their school dances. Such popular "up-do"s may take anywhere from forty-five minutes to two hours to complete. These demands on a stylist's time, regrettably, force many salons to turn away numerous customers during prom season. The present invention provides for a stylist to create almost any of the desired elaborate and elegant hairstyles in less than half the time previously needed. The means and methods of styling taught by the present invention provides for a stylists to schedule a greater number of clients, even during very busy seasons, such as the school prom season, thus, eliminating the necessity to turn away customers due to lack of time. Serving customers that were previously turned away obviously means more profits for the stylists and salon.

Due to the time consuming nature of the "up-do" style, and the frustration it causes for many stylists, some stylists and salons have decided to forgo the potential profits derived from "up-do" customers and have eliminated them at their salons. By supplying an easier and faster alternative to completing the up-do hair style, this invention provides a way around the previous drawbacks of this hair style supplying another revenue stream for salons. The present invention teaches stylists, who have previously believed that extremely difficult styles were unprofitable and/or too time consuming, a method that makes elaborate hair styles a viable and vibrant area of their business.

Another profitable, but sometimes problematic, circumstance for salons is in catering to bridal parties, where it is not uncommon for a bridal party to include up to twenty members with each member desiring a unique hair style that is, nevertheless, in keeping with the other hairstyles chosen by the group, and that is appropriate for a formal wedding celebration. Under such circumstances, a salon's staff often feels severely stressed. Smaller salons often have to turn away large bridal parties when the requests are beyond their capacities. The present invention provides both smaller and larger salons with the ability to create numerous elaborate hair styles in less than half or a quarter of the time such styles previously required. With the present invention, large bridal parties can have the intricate hair styles they want and salons can provide such styles with fewer stylists and in a greatly reduced amount of time. The pre-styled, ready to attach curls of the present invention provide for elaborate hair styles to be achieved simply and quickly. Using the means and methods of the present invention, a stylist merely attaches the pre-styled, individual curls of this invention to the natural hair of a client to create a fully styled elegant coiffure, in as little time as about fifteen to twenty minutes without curling, combing, and fussing with each strand of natural hair on a client's head. By simply pinning back a client's natural hair, stylists provide themselves with a ready canvas to which the curls of the present invention are attached to create a hairdo masterpiece.

Some potential beauty salon patrons desirous of having their hair styled in one of these more complicated styles may be hesitant or unable to afford the fees associated with the creation of an elaborate hair style at a salon. Some of these elaborate styles require a wide array of styling tools and techniques that are generally unavailable for home use. Thus, cost conscience consumers previously have had to decide to spend more than they would like to in order to go to a salon to obtain a desired hair style or, alternatively, they must lower their expectations and have their hair styled in a more modest creation that could be achieved at home. The current invention provides for the creation of high-style hairdos at a modest cost. As the individual curls and attachments of the present invention require no pre-styling, they can be used by nearly anyone. Virtually anyone with a modest talent for creating hair styles will have the freedom to create or to recreate elaborate hair styles at their own home at a fraction of the cost of going to a salon. As the hair attachments and curls of the present invention may be reusable, the cost savings can increase with each use.

The present invention makes available all of these improvements by providing means for creating a desired hair style, comprising:

a plurality of individual curls required to create a desired hair style, wherein attaching each of the required individual curls to a head creates the desired hairstyle.

In one preferred embodiment, the individual curls are made from natural hair, whereas in another preferred embodiment the individual curls are made from synthetic hair.

In yet another embodiment, individual curls are provided having any desired color.

A further embodiment provides methods of creating a desired hair style using a plurality of individual hair curls, comprising the steps of:

a. providing a plurality of individual curls required to create a desired hair style;

b. attaching each of the required individual curls to a head creating the desired hairstyle.

An additional embodiment provides for a kit for creating a desired hair style comprising a plurality of individual curls and/or hair pieces required to create the desired hair style, wherein the kit may comprise any one of, or a combination of, at least one French curl, at least one spiral or ribbon curl, at least one fountain-shaped curl, at least one braided curl that may or may not be wired, and at least one hair-weft curl.

In the kit at least one individual hair curl may be made from artificial hair, at least one curl may be made from natural hair, and individual curls may be provided in any desired color.

Still other benefits and advantages of this invention will become apparent to those skilled in the art upon reading and understanding the following detailed specification and related drawings.

BRIEF DESCRIPTION OF THE DRAWINGS

In order that these and other objects, features, and advantages of the present invention may be more fully comprehended and appreciated, the invention will now be described, by way of example, with reference to specific embodiments thereof which are illustrated in the appended drawings wherein like reference characters indicate like parts throughout the several figures. It should be understood that these drawings only depict preferred embodiments of the present invention and are not therefore to be considered limiting in scope. Thus, the invention will be described and explained with additional specificity and detail through the use of the accompanying drawings, in which:

FIG. 6*i* is a cross-sectional view, taken along 6*i*-6*i,* illustrating the attachment location of the fan-shaped curl, as shown in FIG. 6*a.

FIG. 8 is a flow chart illustrating an exemplary set of process steps involved in forming the individual, attachable curls of this invention.

A LIST OF THE REFERENCE NUMBERS AND RELATED PARTS OF THE INVENTION

Figure 1:
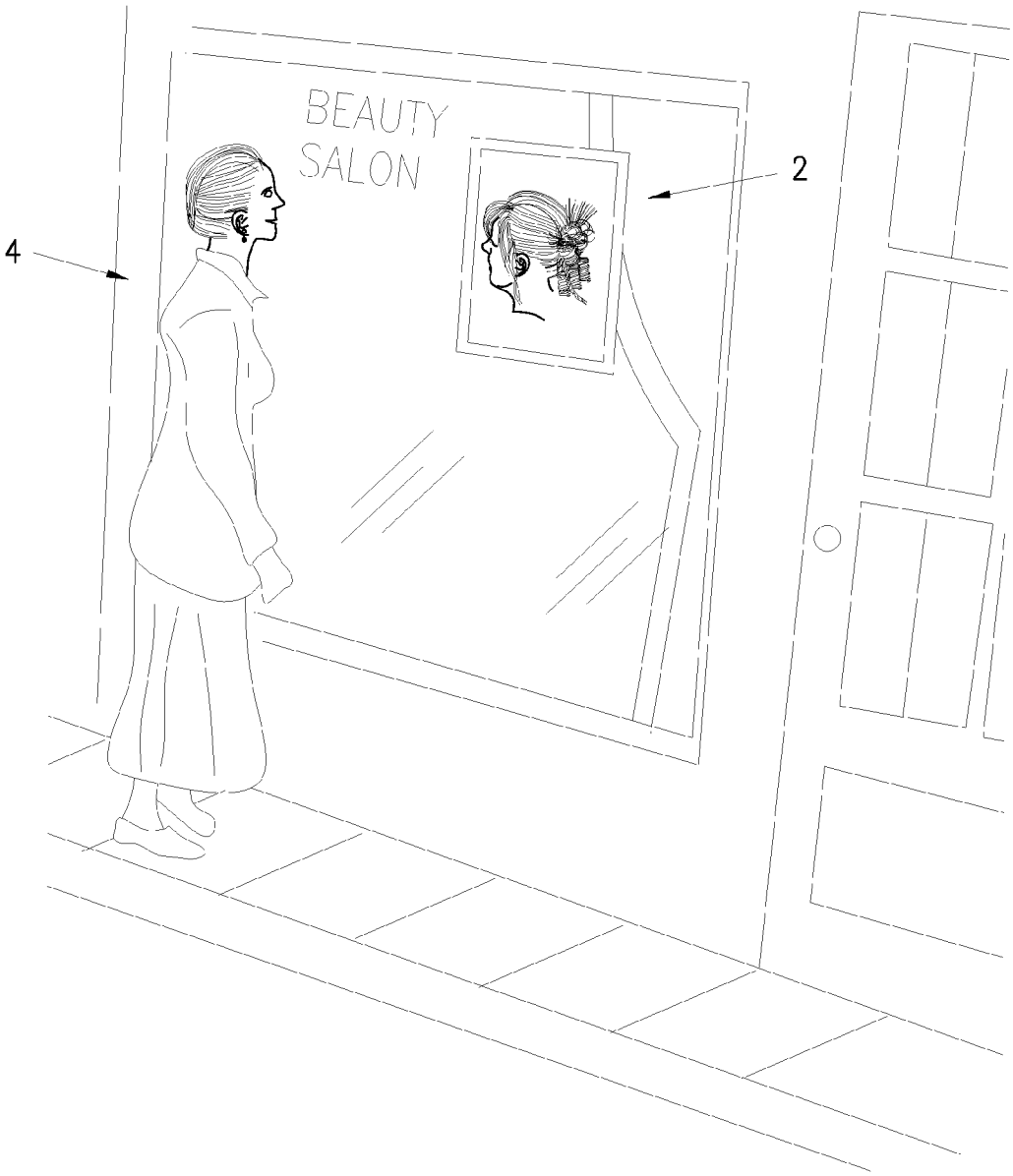
FIG. 1 is a perspective view illustrating a beauty salon patron longing for her hair to be styled exactly like the hairstyle displayed in the picture affixed to the salon window.

2 A photo showing an elaborate hair style attached to a front window of a beauty salon.

4 A woman with shorter hair admiring the hair style in photo 2.

6 Natural hair of woman 4 prepared for attachment of the curls of the present invention.

8 Hands of a stylist shown securing French curls 12 with securing means 10.

10 A securing means, such as a bobby pin or the like, used to secure curls to patron's head.

12 French-curl.

14 Spiral-curl, if cut shorter this would be considered a ribbon curl.

16 Fan-shaped weft curl.

18 Braided-weft curl.

20 Fountain-shaped weft curl.

22 Sized hair-weft that may be used as is or may be formed into any of the previously mentioned curls.

24 A large number of straight individual hair strands that constitute curl 16.

26 Unbound hairs of first end of the hair-weft fan curl 16.

28 Bound hair of second end of hair-weft fan curl 16.

30 An adhesive-like securement means by which individual hair strands of second end of weft are bound together and which is subsequently used to attach the curl to a patron's head.

32 A large number of long, straight individual hair strands that constitute curl 22.

34 Unbound hair of first end of the hair-weft 22.

36 Bound ends of the hair strands of 22.

38 An adhesive-like securement means that serves to bind individual hair strands of 22 to each other and which is subsequently used to attach the curl to a patron's head.

40 A large number of curled hair strands constituting French-curl 12.

42 An adhesive-like securement means that serves to bind individual hair strands of curl 12 to each other and which is subsequently used to attach the curl to a patron's head.

44 Large number of spirally curled hair strands that constitute spiral-curl 14.

46 An adhesive-like securement means that serves to bind individual hair strands of spiral-curl 14 to each other and which is subsequently used to attach the curl to a patron's head.

48 Large number of curved strands of hair that constitute fountain-shaped curl 20.

50 Free ends of fountain-shaped curl 20.

52 Center of fountain-shaped curl 20 where the individual hair strands converge and are bound.

54 An adhesive-like securement means binding individual hair strands of fountain-shaped curl 20 to each other and which is subsequently used to attach the curl to a patron's head.

56 Large number of braided hair strands that constitute hair piece 18.

58 An adhesive-like securement means binding individual hair strands of braid curl 18 to each other and which is subsequently used to attach the curl to a patron's head.

60 One of the three sections of braided curl 18, which are each made up of a large number of hair strands.

62 Wire support that traverses the center of the entire hair piece 18.

DEFINITIONS

Curl, as used herein, refers to any of the hair pieces, curls, braids, or fans that are made according to the principles of the present invention, including but not limited to French curls, spiral-curls, fountain-shaped curls, fan-shaped curls, hair-wefts, and wired or non-wired braids, where each curl is individually, easily, and rapidly attached to a patron's head to create or replicate nearly any desired hairstyle, and where each curl may be made of natural or synthetic hair of any desired hair color.

Curl—fan shaped, as used herein refers to a type of curl (illustrated in FIG. 6*b*) having the hairs of one end of a "bunch" of hair bound together by a securement means to form means by which the is subsequently attached to a patron's head. The narrow end of fan curl 16 is formed when the hairs of second end 28 are bound tightly and securely together to form securing means 30, whereas the unbound hairs of first end 26 fan outward to form fan curls having their distinctive fan shape. It should be noted that a fan curl, such as the example shown in FIG. 6*ab*, may be of any desired thickness, length, width, texture, and color.

Figure 6B:
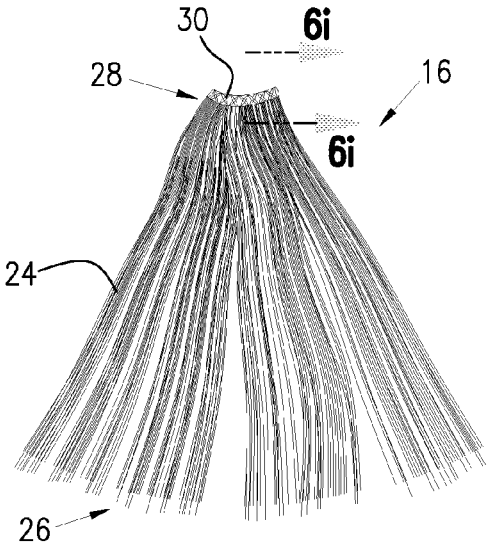
FIG. 6*b* is a front perspective view illustrating a fan-shaped curl.
Figure 6A:
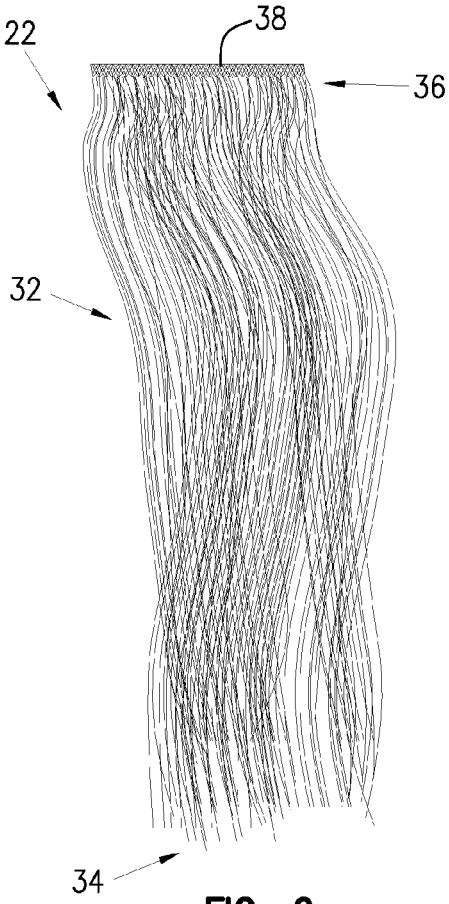
FIG. 6*a* is a front perspective view illustrating an uncurled weft curl.
Figure 6C:
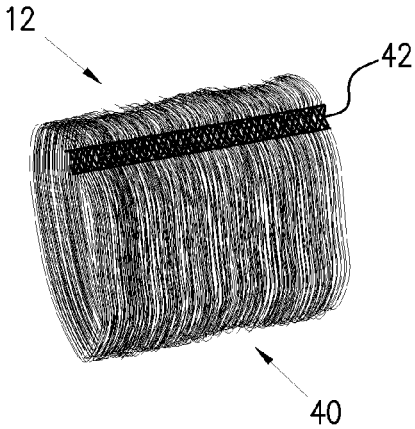
FIG. 6*c* is a top perspective view illustrating a French curl.
Figure 6D:
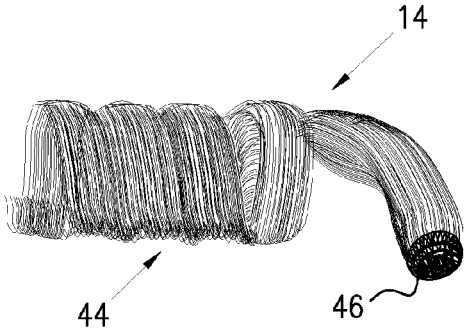
FIG. 6*d* is a side perspective view illustrating a spiral curl.
Figure 6E:
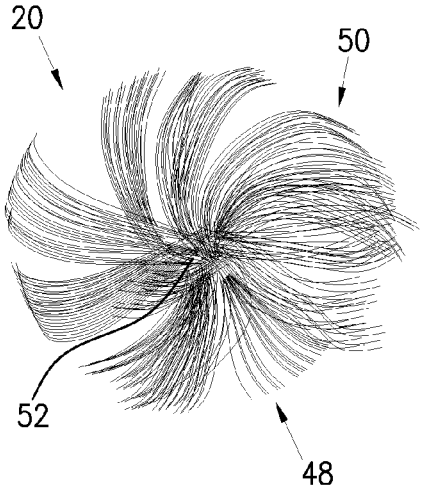
FIG. 6*e* is a top perspective view illustrating a fountain curl, which may also be referred to as an accessory piece.

Curl—fountain-shaped, as used herein refers to a type of curl that is illustrated in FIG. 6*e*, where a top perspective view of such a fountain-shaped curl shows a "bunch, spray, or bouquet" of hairs having one end of the bunch of hairs tightly joined together while the ends not joined together spray outward in a curved fashion from the center of the bunch providing for a unique fountain effect. Illustrated in FIG. 6*e*, is a view of the joined end of the fountain spray of hairs showing how the hairs are attached to each other.

Hairstyle, as used herein, refers to any particular hair-arrangement. A hairstyle may be simple and informal or may be extremely elaborate and formal. Particular hairstyles may require one, several, or all of the curls made according to the principles of the present invention.

Hair-weft, as used herein, typically, but not necessarily, refers to a thickness of hair, natural or synthetic, that is commercially available in five foot lengths. This hair-weft, which is also referred to as a hair swatch, is the starting material for creating all of the curls of the present invention.

Hair-weft curl, as used herein, refers to a sized cutting taken from a hair-weft and may be used as is as a hair-weft curl and may be shaped into any other type of curl.

Securement means, as used herein, refers to a means for binding the individual hairs of a hair-weft together to secure the hair-weft and to provide a means to attach the weft-curl to a person's head.

Sized hair-weft, as used herein, refers to those lengths of hair-weft that have been taken from the commercially available length of hair-weft, as described above, and that are used to form the curls of the present invention.

It should be understood that the drawings are not necessarily to scale. In certain instances, details which are not necessary for an understanding of the present invention or which render other details difficult to perceive may have been omitted.

DETAILED DESCRIPTION

Referring now to the drawings that present exemplary embodiments of the present invention to demonstrate how the invention can accomplish the advancements detailed above, and overcome the disadvantages of the prior art mentioned above. It should be noted that the disclosed invention is disposed to many variations in sizes of the curls, shapes of the curls, and the form, such as wider or narrower hair curls, hair curls of varying color, degree of curl, made of different materials, having a variety of attachment means, and so forth, all which will be discussed to some extent below. Therefore, the embodiments described herein are provided with the understanding that the present disclosure is intended as illustrative and is not intended to limit the invention to the embodiments described herein.

FIG. 1 presents perspective view of beauty salon patron 4 strolling by a storefront of a beauty salon. The attention of beauty salon patron 4 is caught by photo 2 showing a woman modeling an elaborate hair style. FIG. 1 captures the need for the present invention by illustrating a reoccurring problem in the fashion industry, that is, salon patrons who desire and demand advertised hair styles. The hairstyle pictured in the window of the hair salon includes a variety of curls, including French curls, spiral-curls, fountain-shaped curls, fan-shaped curls, hair-wefts, and wired or non-wired braids. Such elaborate hairstyles, however, are generally technically difficult and time consuming to create. There are times when such elaborate hairdos are literally impossible to create because of the limitations presented by many patrons' natural hair. For example, the shorter hair of patron 4 makes recreating any elaborate hair style requiring longer hair difficult if not impossible without using the means and the methods taught by the present invention.

Figure 2:
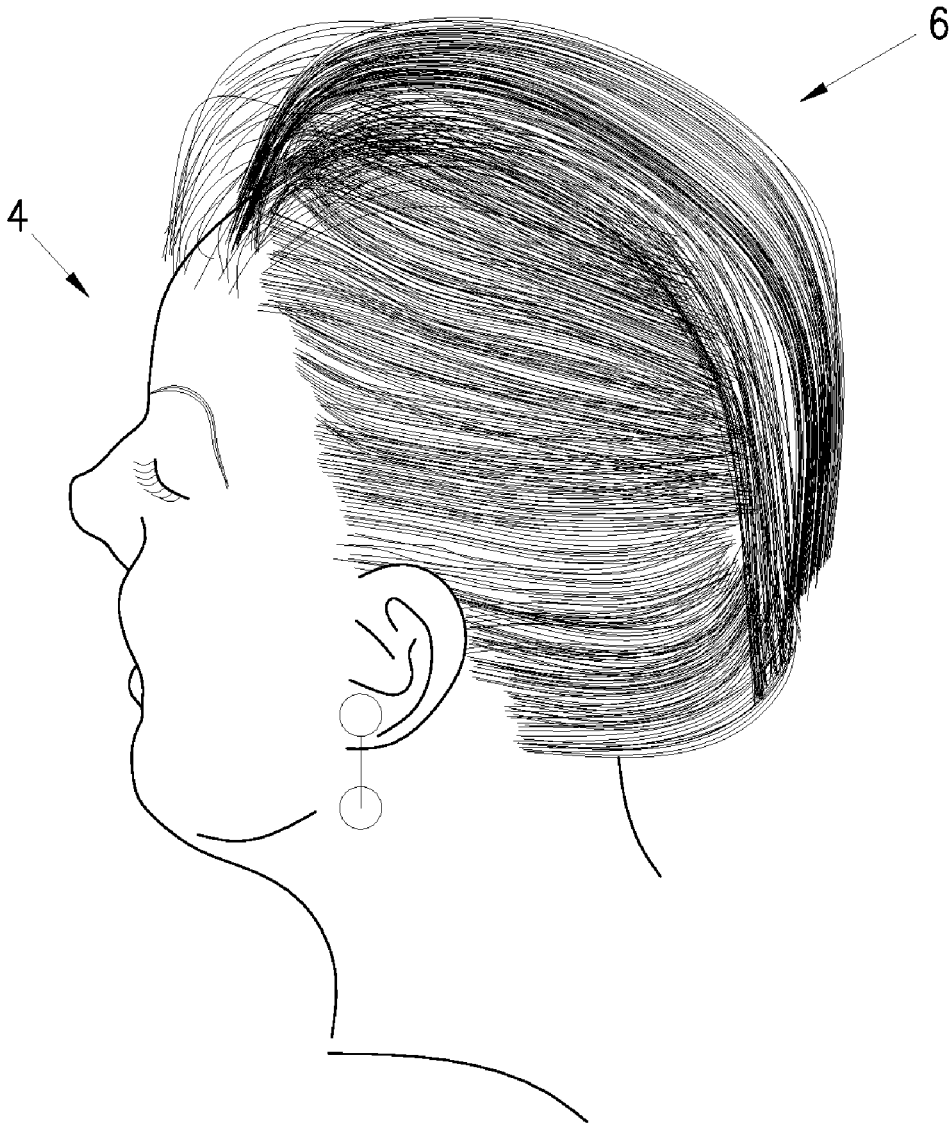
FIG. 2 is a side perspective view of the head of the patron, as shown in FIG. 1, illustrating her shorter hair arranged for attachment of the curls of the invention.

FIG. 2 is a close-up view of patron 4, as illustrated in FIG. 1, with her shorter hair shown prepared for creation 6 of the hairdo she desires. The shorter hair of patron 4, as shown in FIG. 2, demonstrates one instance where there is a clear need for the attachable, individual curls of the present invention to create the patron's desired elegant hairdo.

Figure 3:
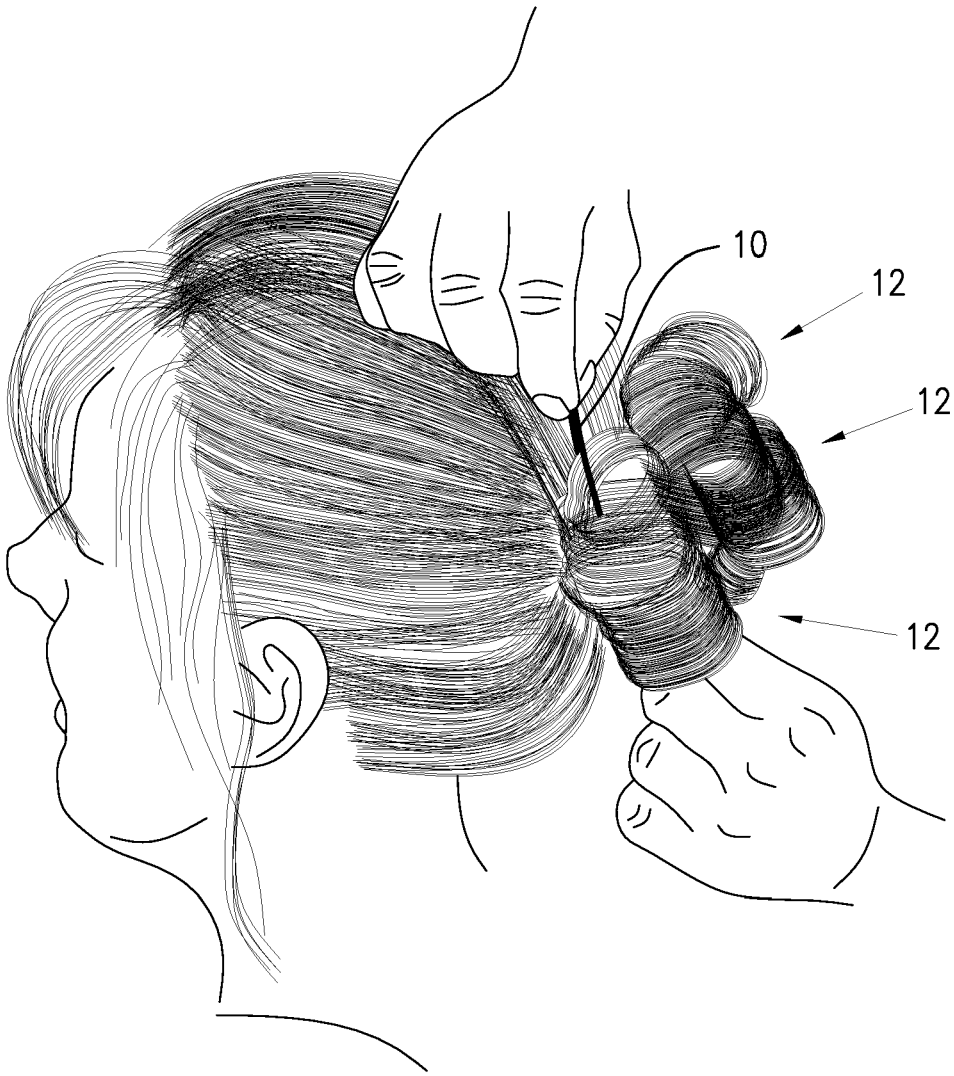
FIG. 3 is a side perspective view of the head of the patron, as shown in FIG. 2, illustrating the hands of a hair dresser in the process of attaching the curls of the present invention.
Figure 4:
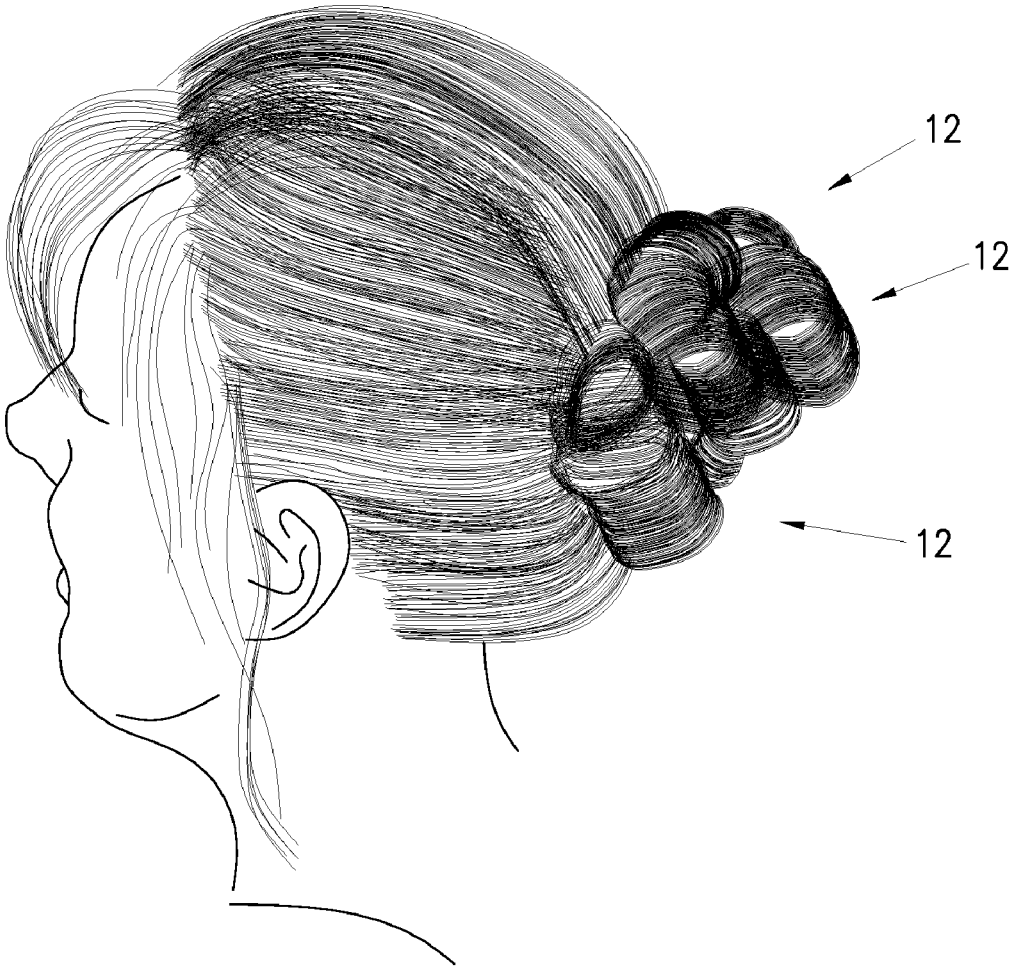
FIG. 4 is a side perspective view illustrating the female head of FIG. 3 after multiple French curls were attached.
Figure 5:
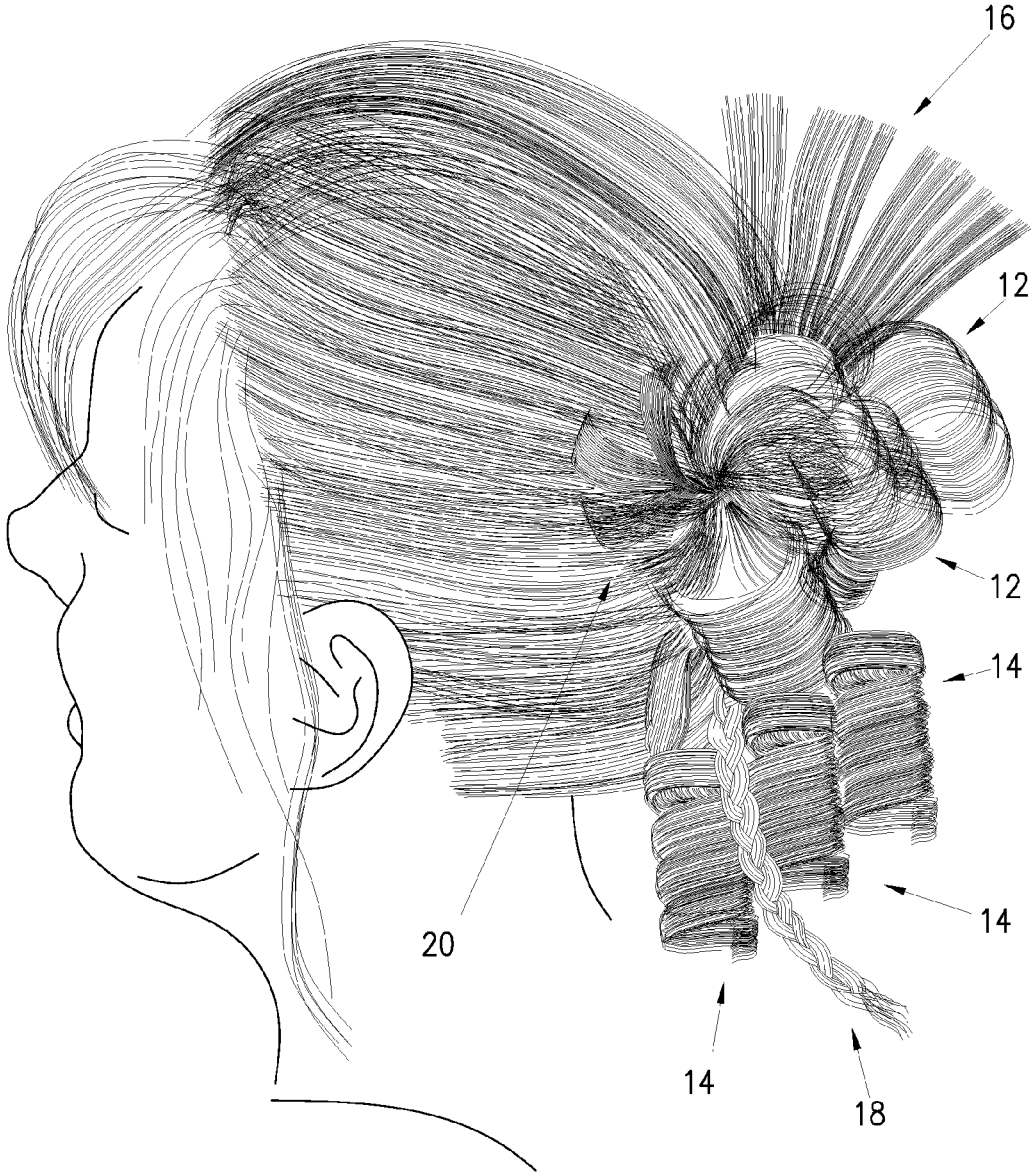
FIG. 5 is a side perspective view of the female head of FIG. 4, illustrating the successful recreation of the hair style desired by the patron achieved by the attachment of multiple French curls, multiple spiral curls, a braided hair attachment, a fan-shaped hair attachment, and a fountain-shaped hair attachment.

The styling method of the present invention is illustrated in FIGS. 3, 4, and 5. FIG. 3 shows the hands 8 of a hair stylist attaching a plurality of French curls 12 of the present invention using hair pin attaching means 10. Although, the attaching means in this example is described and pictured as a straight pin, there are many other attaching means that may be used as is well-known by those of ordinary skill in the art. French curls 12, as depicted in FIG. 3, are exemplary, and should not be taken to be the only type of curl that could be used in styling a desired hairdo. Alternatively, any one of curls illustrated in FIGS. 6*a*-6*i*, or any combination of curls 14, 16, 18, or 20 could have been just as easily be chosen, depending on the style that is desired.

An intermediate step in the creation of the exemplary hairdo using the series of curls of the present invention is illustrated in FIG. 4, which shows a patron with three separate French curls 12 secured to her head. In this example, the elaborate hairdo desired by patron 4 is not complete, as the other required curls have yet to be attached. FIG. 4, however, could just as well represent an ending point in the styling method of the present invention if it were determined that a simpler look was desired.

Following the attachment of the curls 12, as shown in FIG. 4, curls 14, 16, 18 and 20 are secured to the patron's natural hair, as illustrated in FIG. 5. These are the curls that are required to create the desired elaborate hairdo the patron saw when looking at the picture attached to the shop window.

The curls of the present invention can take many forms as illustrated in FIGS. 6*a*, 6*b*, 6*c*, 6*d*, 6*e*, and 6*g*. Each curl is provided with a unique securing means that performs two functions. One function of the securing means is to bind the individual hairs of a hair-weft together. The securing means is also used to attach the curls of the present invention to a person's head.

FIG. 6*a* illustrates sized hair-weft 22 that is available in a variety of lengths, varying thickness, color, etc. depending on its intended use. Sized hair-weft 22, i.e., cut from commercial length hair-weft, having first end 34 and second end 36 is the basic "curl" of the invention, as it is used to form all other desired curls using the principles of the present invention or sized hair-weft 22 may be used as is to form what is referred to herein as a weft-curl. Following the principles of the present invention, the hair of first end 34 of a sized hair-weft may be formed into a curl. When the curl is fully "set" or formed, the hairs of second end 36 are bound together to fix them into a single unit, referred to herein as securing means 38. FIG. 6*a* illustrates this by showing individual hair strands 36 of second end of hair-weft 22 bound together using an adhesive, such as glue from a hot glue-gun, to form securing means end 38 which is subsequently used as a securing means to secure weft-curl 22 to a user's natural head of hair. The loose unbound, and uncurled hairs of first end 34 of weft 22 are designed, in this example, to hang freely and flow giving the user flexibility as to where to attach weft 22. For example, weft 22 may be attached so as to drape down from the back of the user's head. This attachment allows a customer to present an illusion of having long luxurious hair and may be use in combination with the other numerous hair attachment variations disclosed herein.

Figure 6F:
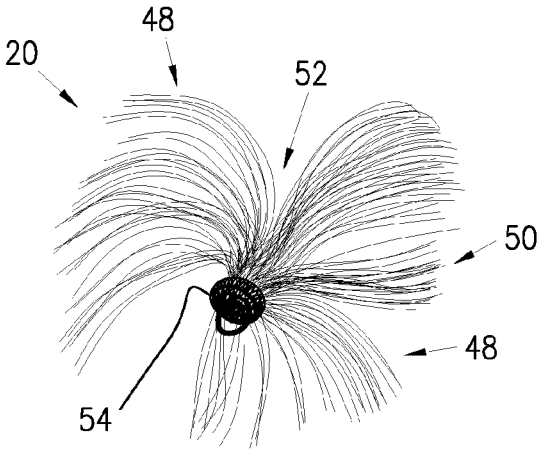
FIG. 6*f* is a perspective view illustrating the bottom of the fountain curl of FIG. 6*e;*
Figure 6H:
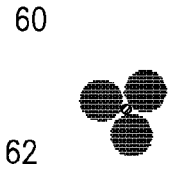
FIG. 6*h* is a cross-sectional view, taken along 6*h*-6*h,* illustrating the three stands that form the braid and the inner wire used for support.
Figure 6I:
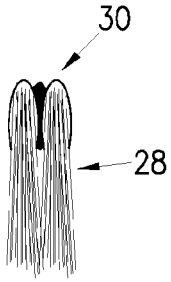

FIG. 6*b* shows the hairs of second end 28 of weft fan curl 16 bound together by an adhesive securement means, which for example could be some form of glue, such as the glue from a hot glue gun, to form securing means 30 which is subsequently used to attach the curl to a patron's head. The narrow end of fan curl 16 is formed when the hairs of second end 28 are bound tightly and securely together to form securing means 30, whereas the unbound hairs of first end 26 fan outward to form fan curls having their distinctive fan shape. FIG. 6*i* offers a close-up side view of the bound end of fan curl 16 as shown in FIG. 6*b* showing securement means 30 binding the loose hair strands into one unit. It should be noted that fan curl 16 as shown in FIG. 6*b* may be of any desired length, width, texture, and color. Moreover, individual strand 24 counts can vary the thickness of curl 16, as desired.

FIG. 6*c* shows curl 12, which is also shown in FIGS. 3, 4, and 5. Curl 12 is often referred to by those in the industry as a French curl. French curl 12 is composed of numerous strands 40 that form a thick concentric curl that may be large or small. The present invention provides for curled strands 40 to be joined at their ends by securement means 42. Securement means 42 subsequently provides a convenient and aesthetically pleasing way to attach curl 12 to a user's natural hair.

FIG. 6*d* illustrate spiral curl 14 that, once again, has securement means 46 and is composed of numerous hair strands 44 that have been pre-styled to have the unique spiral shape. Individual hair strands 44 may be as numerous as the intended effect requires. Degree of curl and circumference of the curl may also vary depending on the intended use, as well as the length and thickness of the strands 44. Spiral curl 14, as with the other curls, may be used alone, or in combination with the many other hair attachments detailed in this invention.

FIG. 6*e* presents a top perspective view of a fountain-shaped curl having numerous individual hair strands 48 that spray outward from center 52. Spiral hair securement means 52 binds the individual hair strands into a single curl unit and then subsequently serves as a means to secure the curl to a client's head. Loose ends of the strands 50 extend in a curved fashion outward from the center area of fountain-shaped curl 20 providing for a unique fountain effect. The fountain-shaped curl 20 gives stylists and users another variation to add glamour, elegance, and novelty to a hair style. A bottom perspective of fountain-shaped hair attachment 20 is shown in FIG. 6*f* where a greater understanding of the design and shape of this preferred embodiment can be obtained.

Figure 6G:
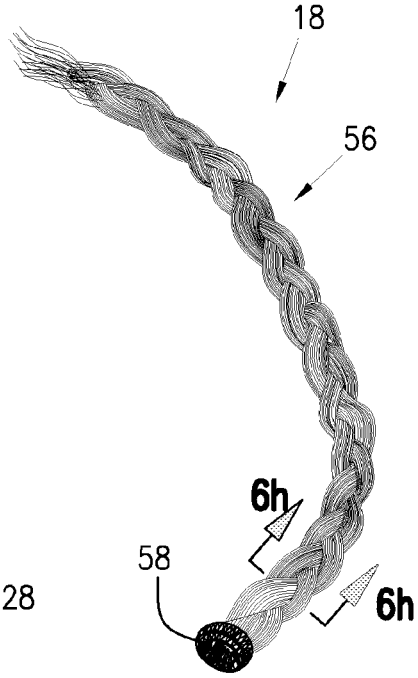
FIG. 6*g* is a side perspective view illustrating a wired-braid curl.

Braided and wired curl 18 is illustrated in FIG. 6*g*. Braid curl 18 also may be formed without a wire, as desired. The length of the braid, with or without wiring may vary according to desire. A longer braid, worn loose or curled on a person's head, will provide an illusion of long hair. Braided curl 16 is formed by braiding strands of hair about wire support 62 as indicated in FIG. 6*h*. Wire support 62 generally traverses the length of the braid to provide for easy arranging and stable positioning of the braid.

Figure 7:
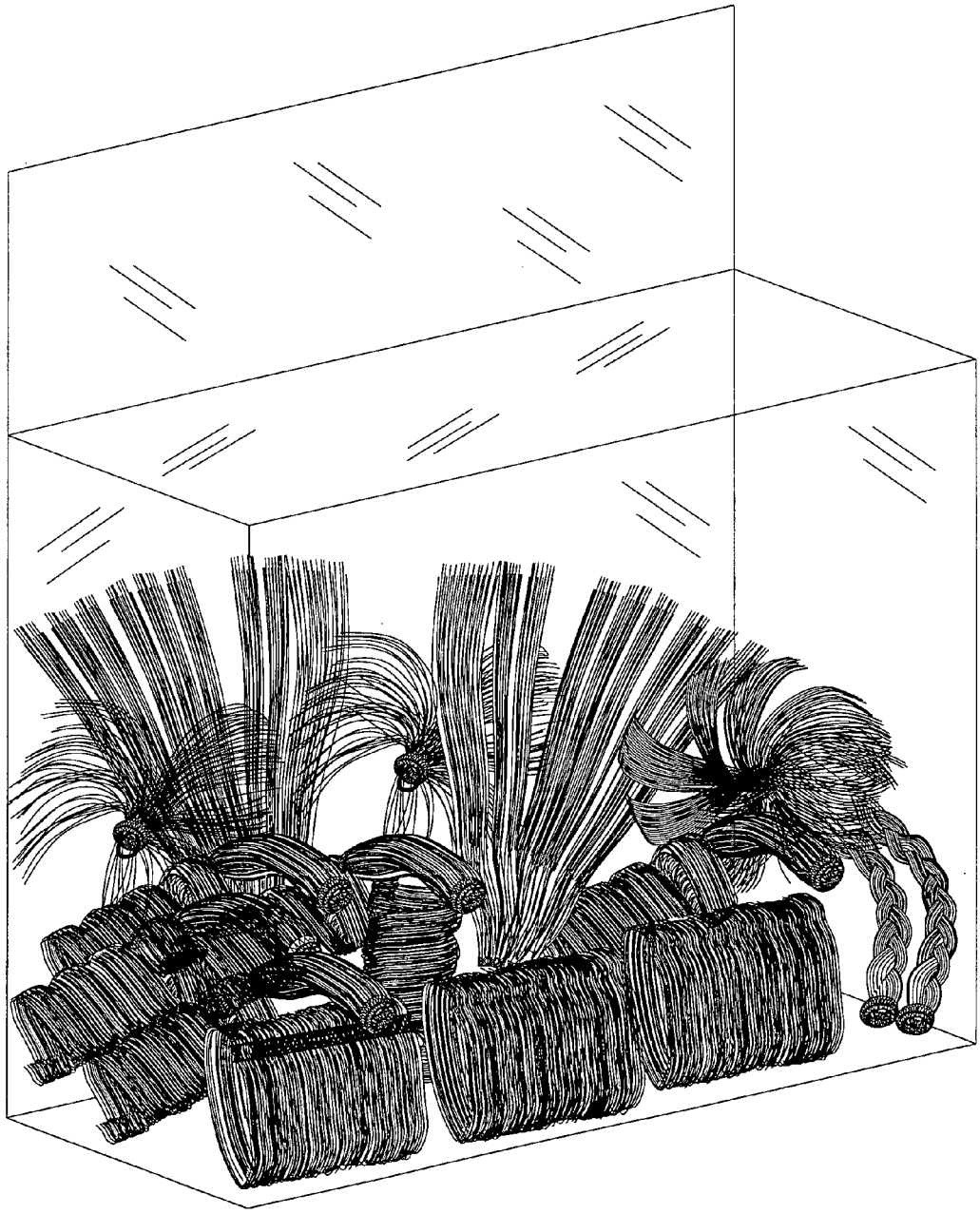
* and FIG. 7 is a front perspective view illustrating a kit of curls that, in this example, includes the curl attachments illustrated individually in FIGS. 6*a,* 6*b,* 6*c,* 6*d,* 6*e* and 6*g.*

FIG. 7 illustrates a curl kit that contains any desired number and combination of the curls of the present invention as well as of other curl designs that are not relied upon for illustration herein. Each curl may be uniformly colored or may be multi-colored. The curls and attachments contained in each kit are chosen to be of a uniform color or an assortment of colors. It should be understood that the curls and hair pieces disclosed herein may be made using natural or synthetic hair. The curls may be presented as plain or decorated with, for example sparkles, flowers, bows, jewels, other jewelry items, thematic decorations for all of the various holidays and days of celebration. They are available as disposable or reusable curls. Kits may be chosen to contain only curls or to contain accessory attachment means and decorative items. If desired, kits and/or individual curls may be purchased with photos of and directions for achieving a desired hairdo.

The steps of one preferred method of making, i.e., forming, the curls of the present invention are shown in FIG. 8. Following this example, the process starts with providing a commercially available hair-weft that is commonly available in five foot lengths. Of course, it is to be understood that a hair-weft of a shorter or longer length could be used, as well. The commercially available hair-weft is then divided into a plurality of shorter lengths with each length thus sized, having a first end and a second end. The shortened or "sized" hair-wefts may be used, as is, in the creation of a desired hair-style without further treatment and are referred to as a weft-curls. To form many of the other curls, a first end of the shortened hair-weft must be "set", similar to the method used to set a natural head of hair. For example, to form French curls that before curling require a length of weft of about one foot, a typical five foot weft is cut into five approximately identical lengths. A first end of the shortened hair-wefts or swatches is then formed into a French curl. Any process that will result in a stable curl may be used. One process, for example, may be to wet the hair, form the curl from one end of the weft, spray the formed curl with hair spray, and let the curl sit until a long-lasting curl is formed. The curl may be sprayed with a commercial hair-spray to further stabilize the curl or any other type of hair fixative may be used, such as a gel or pomade. Once the curl is set, the second end, i.e. the uncurled end of the hair-weft is firmly bound using a securement means, that may be a glue or may involve sewing the hair strands together, or may be any other means that will secure the individual hairs to each other providing for the bound end to be used as an attachment means to attach the curl to a person's head.

Thus, it has been shown that the described invention satisfies the heretofore unmet need for a hair styling means and method that provides a user, whether a professional stylist, or a consumer intending to use the device and method at home, with the means and method to easily, rapidly, and inexpensively create an elaborate, sophisticated hair style. The invention also provides for beauty salons to increase their revenue by reducing the time needed to recreate elaborate hair styles. Previous to this invention people with shorter, fine, thin, and/or unmanageable hair were forced to wear heavy and uncomfortable wigs if they wanted a stylish hairdo. The devices and methods as taught herein provides for people with fine, thin, shorter, and/or unmanageable hair to wear elaborate hair styles despite the limitations of their existing natural hair condition.

The foregoing description uses specific and defined nomenclature to provide a thorough understanding of the present invention. However, it will be apparent to one skilled in the art that the specific details are not required in order to practice the invention. Thus, the foregoing descriptions of the specific embodiments of what may be referred to as the Do Faux!™ device and method of styling hair are presented for purposes of illustration and description. They are not intended to be exhaustive or to limit the invention to the precise forms disclosed. Those skilled in the art will recognize that many changes may be made to the curl or kit, such as shape, color, materials, other embodiments, and methods of making the embodiments of the invention described herein without departing from the spirit and scope of the invention, thus, the invention is limited only by the claims.

What is claimed is:

1. A method for creating a plurality of desired elaborate hair styles, comprising the steps of:

a. providing for a set of a plurality of individual attachable preformed curls for creating a plurality of desired elaborate hair-styles, said set containing two or more French curls, two or more spiral-curls, two or more fountain-shaped curls, two or more fan-shaped curls, and/or two or more wired braids, and b. attaching each of said individual attachable curls of said set to a head in a series of steps to create said desired elaborate hairstyle, wherein the steps required to attach said curls require about 15-30 minutes which is a fraction of the time that would be required to create the elaborate hairstyle without said individual curls.

2. The method for creating a desired hair style, as recited in claim 1, further comprising steps for forming and attaching said individual attachable curls, said method comprising the steps of:

a. providing a weft of hair;

b. sizing said weft of hair into desired lengths, said lengths having a first end and a second end;

c. forming said first end of said sized weft into one of said French curls, said spiral-curls, said fountain-shaped curls, said fan-shaped curls, or said wired braids, d. providing a binding means, and e. using said binding means, binding hairs at said second end of said sized weft of hair creating a bound end, wherein said bound end of said sized weft may be used as an attachment means to attach said curl to a person's head.

3. The method for creating a desired hair style, as recited in claim 2, further comprising wherein said binding means is an adhesive binding means.

4. The method for creating a desired hair style, as recited in claim 2, further comprising wherein said binding means is a sewing binding means.

5. The method for creating a desired hair style, as recited in claim 1, further comprising wherein said individual attachable curls are made from natural hair.

6. The method for creating a desired hair style, as recited in claim 1, further comprising wherein said individual attachable curls are made from synthetic hair.

7. A device for creating a desired hair style, comprising:

a device for creating desired elaborate hair styles comprising a plurality of sets for creating a plurality of desired elaborate hair styles, where each set of curls comprises a set containing preformed curls requiring discrete attachment means for creating a desired elaborate hair style, where the curls comprise two or more French curls, two or more spiral-curls, two or more fountain-shaped curls, two or more fan-shaped curls, and/or two or more wired braids, wherein attaching each of said curls of said desired set to a head using discrete attachment means creates the desired hairstyle requiring a fraction of the cost and a fraction of time that would be required creating the elaborate hairstyle without said individual curls.

8. The device for creating a desired hair style, as recited in claim 7, further comprising wherein said individual attachable curls are made from natural hair.

9. The device for creating a desired hair style, as recited in claim 7, further comprising wherein said individual attachable curls are made from synthetic hair.

10. The device for creating a desired hair style, as recited in claim 7, further comprising wherein said plurality and variety of individual attachable curls are attached to a head using only bobby pins.

11. A kit for creating a desired hair style, said kit comprising:

a plurality of individual attachable preformed curls requiring discrete attachment means for creating desired elaborate hair styles comprising two or more French curls, two or more spiral-curls, two or more fountain-shaped curls, two or more fan-shaped curls, and/or two or more wired braids curls, wherein attaching each of said individual attachable curls of said kit to a head using discrete attachment means creates said desired elaborate hairstyle requiring a fraction of the cost and a fraction of time that would be required creating the elaborate hairstyle without said individual curls.

12. The kit, as recited in claim 11, further comprising said two or more French curls.

13. The kit, as recited in claim 11, further comprising said two or more spiral-curls.

14. The kit, as recited in claim 11, further comprising said two or more fountain-shaped curls.

15. The kit, as recited in claim 11, further comprising said two or more wired braid curls.

16. The kit, as recited in claim 11, further comprising said two or more fan-shaped curls.

17. The kit, as recited in claim 11, further comprising wherein said individual attachable hair curls are made from artificial hair.

18. The kit, as recited in claim 11, further comprising wherein said individual attachable hair curls are made from natural hair.

19. The kit, as recited in claim 11, further comprising wherein said individual attachable curls are of any desired color.

* * * * *

UNITED STATES PATENT AND TRADEMARK OFFICE

CERTIFICATE OF CORRECTION

PATENT NO. : 7,472,708 B2
APPLICATION NO. : 11/132057
DATED : January 6, 2009
INVENTOR(S) : Pamela Eigenbrod, Laura Peters and Dorothy Tudor It is certified that error appears in the above-identified patent and that said Letters Patent is hereby corrected as shown below:

Column 12, line 45 (Claim 7, Line 1) Delete "comprising" and insert --consisting of--

Column 12, line 46 (Claim 7, Line 2) Delete "comprising" and insert --consisting of--

Column 12, line 49 (Claim 7, Line 5) Delete "comprising" and insert --consisting of--

Column 13, lines 5-6 (Claim 11, Line 1) Delete "comprising" and insert --consisting of--

Signed and Sealed this

Seventeenth Day of August, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,472,708 B2
APPLICATION NO. : 11/132057
DATED : January 6, 2009
INVENTOR(S) : Pamela Eigenbrod, Laura Peters and Dorothy Tudor It is certified that error appears in the above-identified patent and that said Letters Patent is hereby corrected as shown below:

Claim 7, Line 1: Delete "comprising" and insert --consisting of--

Claim 7, Line 2: Delete "comprising" and insert --consisting of--

Claim 7, Line 5: Delete "comprising" and insert --consisting of--

Claim 11, Line 1: Delete "comprising" and insert --consisting of--

Signed and Sealed this

Thirty-first Day of August, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,472,708 B2
APPLICATION NO. : 11/132057
DATED : January 6, 2009
INVENTOR(S) : Pamela Eigenbrod, Laura Peters and Dorothy Tudor It is certified that error appears in the above-identified patent and that said Letters Patent is hereby corrected as shown below:

Column 12, line 45 (Claim 7, Line 1): Delete "comprising" and insert --consisting of--

Column 12, line 46 (Claim 7, Line 2): Delete "comprising" and insert --consisting of--

Column 12, line 49 (Claim 7, Line 5): Delete "comprising" and insert --consisting of--

Column 13, line 5 (Claim 11, Line 1): Delete "comprising" and insert --consisting of--

This certificate supersedes the Certificate of Correction issued August 31, 2010.

Signed and Sealed this

Twenty-eighth Day of September, 2010

David J. Kappos

David J. Kappos
*Director of the United States Patent and Trademark Office*